US008221949B2

(12) United States Patent
Tajima et al.

(10) Patent No.: US 8,221,949 B2
(45) Date of Patent: Jul. 17, 2012

(54) TONER

(75) Inventors: Hisakazu Tajima, Wakayama (JP); Kohei Katayama, Wakayama (JP); Eiji Shirai, Wakayama (JP); Akihiro Eida, Wakayama (JP)

(73) Assignee: Kao Corporation, Tokyo (JP)

( * ) Notice: Subject to any disclaimer, the term of this patent is extended or adjusted under 35 U.S.C. 154(b) by 240 days.

(21) Appl. No.: 12/618,883

(22) Filed: Nov. 16, 2009

(65) Prior Publication Data

US 2010/0136469 A1 Jun. 3, 2010

(30) Foreign Application Priority Data

Dec. 3, 2008 (JP) ..... 2008-308721

(51) Int. Cl.
*G03G 9/00* (2006.01)

(52) U.S. Cl. ..... 430/109.4

(58) Field of Classification Search ..... 430/109.4
See application file for complete search history.

(56) References Cited

U.S. PATENT DOCUMENTS 6,835,518 B2 12/2004 Tachi et al.
6,852,461 B2 * 2/2005 Sato et al. ..... 430/109.4
7,160,660 B2 1/2007 Dojo et al.
7,217,485 B2 5/2007 Hasegawa et al.

FOREIGN PATENT DOCUMENTS

| | | |
|---|---|---|
| JP | 2003-122059 | 4/2003 |
| JP | 2004-279842 | 10/2004 |
| JP | 2005-208552 | 8/2005 |
| WO | WO 2007/105737 | 9/2007 |

OTHER PUBLICATIONS

First Office Action issued Feb. 29, 2012, in Chinese application No. 200910225668.5 (with English translation).

* cited by examiner

*Primary Examiner* — Mark A Chapman
(74) *Attorney, Agent, or Firm* — Oblon, Spivak, McClelland, Maier & Neustadt, L.L.P.

(57) ABSTRACT

A toner containing a resin binder containing two kinds of polyesters having softening points that differ by 10° C. or more, a colorant and a charge control agent, wherein the two kinds of polyesters contain a polyester A having a softening point of from 105° to 140° C. and a glass transition temperature of from 30° to 55° C., and a polyester B having a softening point of from 140° to 170° C. and a glass transition temperature of exceeding 55° C. and 80° C. or lower. The toner of the present invention is usable in, for example, development of latent images formed in electrophotography, electrostatic recording method, electrostatic printing method or the like.

10 Claims, No Drawings

TONER

FIELD OF THE INVENTION

The present invention relates to a toner usable in, for example, development of latent images formed in electrophotography, electrostatic recording method, electrostatic printing method or the like.

BACKGROUND OF THE INVENTION

Recently, miniaturization and speeding up of electrophotographic apparatuses are earnestly desired, thereby demanding to lower the lowest fixing temperatures of the toners and extend their fixing temperature regions.

In order to meet the demands, a toner containing two kinds of polyesters having different softening points, for example, a toner containing a low-softening point polyester having a softening point of 80° C. or higher and lower than 120° C. and a high-softening point polyester having a softening point of 120° C. or higher and 170° C. or lower (see JP-A-2003-122059); a toner containing two kinds of polyesters having softening points that differ by 30° C. or more and 60° C. or less, and glass transition temperatures that differ by less than 10° C. (see JP-A-2004-279842); a toner containing a resin having a softening point of 80° C. or higher and 120° C. or lower and a resin having a softening point of 120° C. or higher and 160° C. or lower (JP-A-2005-208552) are proposed.

SUMMARY OF THE INVENTION

The present invention relates to a toner containing a resin binder containing two kinds of polyesters having softening points that differ by 10° C. or more, a colorant and a charge control agent, wherein the two kinds of polyesters contain a polyester A having a softening point of from 105° to 140° C. and a glass transition temperature of from 30° to 55° C., and a polyester B having a softening point of from 140° to 170° C. and a glass transition temperature in the range of exceeding 55° C. and 80° C. or lower.

DETAILED DESCRIPTION OF THE INVENTION

However, while a toner containing a low-softening point resin as described above has improved low-temperature fixing ability, the toner is likely to lower its resin strength. As a result, with the demands of speeding up, if even more mechanical or thermal stresses are applied to a toner, there are some disadvantages that the toner has a lowered hot offset resistance, lowered triboelectric stability, and generates filming on a transfer roller or a developing blade, or filming on a photoconductor, thereby worsening image quality reliability on durability printing.

In addition, since a polyester has a strong negative chargeability, a positively chargeable charge control agent must be added in a large amount in order to use the polyester as a resin binder for a positively chargeable toner. However, the present inventors have found that if a charge control agent is added in a large amount in a toner containing a low-softening point polyester and a high-softening point polyester, there are some disadvantages that the charge control agent would not be sufficiently dispersed due to a large difference in viscosities between the low-softening point polyester and the high-softening point polyester, so that sufficient image qualities cannot be obtained owing to the generation of background fogging and the lowering of solid image quality.

The present invention relates to a toner having excellent low-temperature fixing ability and offset resistance, a wide fixing temperature region, and excellent image quality reliability on durability printing. Further, the present invention relates to a positively chargeable toner that has excellent triboelectric stability, and prevents generation of background fogging or lowering of solid image quality.

The toner of the present invention exhibits some effects that the toner has excellent low-temperature fixing ability and offset resistance, a wide fixing temperature region, and excellent image quality reliability on durability printing. In addition, the positively chargeable toner of the present invention exhibits some effects that the toner has excellent triboelectric stability, and prevents generation of background fogging or lowering of solid image quality.

These and other advantages of the present invention will be apparent from the following description.

The toner of the present invention has a feature that the toner contains two kinds of polyesters having different softening points, and further different glass transition temperatures. By using a polyester A having a softening point of from 105° to 140° C. and a glass transition temperature of from 30° to 55° C., the resulting toner has improved low-temperature fixing ability and cold offset resistance. In addition, by using a polyester B having a softening point of from 140° to 170° C. and a glass transition temperature of exceeding 55° C. and 80° C. or lower, the resulting toner has improved hot offset resistance. Further, by controlling the softening points of the two kinds of the polyester within a certain range, the resulting toner has improved triboelectric stability, thereby improving image quality reliability on durability printing.

In addition, in the production of a positively chargeable toner, by controlling the softening points of the two kinds of polyesters within a certain range, an appropriate shear can be applied upon melt-kneading the raw materials, so that the dispersion of the charge control agent can be maintained at a favorable level, whereby consequently triboelectric stability of the resulting toner is improved, generation of background fogging is prevented, and solid image quality is improved.

Of the above two polyesters having different softening points, the polyester A having a lower softening point has a softening point of 105° C. or higher, preferably 110° C. or higher, and more preferably 115° C. or higher, from the viewpoint of improving hot offset resistance of a toner, improving image quality reliability on durability printing, and improving dispersibility of a colorant or a charge control agent in the resin binder. In addition, the polyester A has a softening point of 140° C. or lower, preferably 135° C. or lower, and more preferably 130° C. or lower, from the viewpoint of improving low-temperature fixing ability and cold offset resistance of a toner. In other words, from these viewpoints taken together, the polyester A has a softening point of from 105° to 140° C., preferably from 110° to 135° C., and more preferably from 115° to 130° C.

On the other hand, the polyester B having a higher softening point has a softening point of 140° C. or higher, preferably 145° C. or higher, and more preferably 150° C. or higher, from the viewpoint of improving hot offset resistance of a toner and improving image quality reliability on durability printing. In addition, the polyester B has a softening point of 170° C. or lower, preferably 165° C. or lower, and more preferably 160° C. or lower, from the viewpoint of improving low-temperature fixing ability and cold offset resistance of a toner, and improving dispersibility of a colorant or a charge control agent in the resin binder. In other words, from these viewpoints taken together, the polyester B has a softening point of from 140° to 170° C., preferably from 145° to 165° C., and more preferably from 150° to 160° C.

The difference in the softening points of the polyester A and the polyester B is 10° C. or more, preferably 15° C. or more, and more preferably 20° C. or more, from the viewpoint of improving low-temperature fixing ability, cold offset resistance and hot offset resistance of a toner. In addition, the difference in the softening points is preferably 65° C. or less, more preferably 50° C. or less, and even more preferably 40° C. or less, from the viewpoint of improving dispersibility of a colorant or a charge control agent in the resin binder and improving image quality reliability on durability printing. In other words, from these viewpoints taken together, the difference in the softening points of the polyester A and the polyester B is 10° C. or more, preferably from 10° to 65° C., and more preferably from 15° to 50° C., even more preferably from 20° to 40° C.

The softening point of the polyester can be elevated, for example, by extending the reaction time of the formation of polyester, or by using a trivalent or higher polyvalent raw material monomer. Also, the softening point can be decreased by using a monovalent raw material monomer. Here, the polyester is intended to mean both the polyester A and the polyester B. The same applies to the description given hereinafter.

Further, the polyester A has a glass transition temperature of 30° C. or higher, preferably 33° C. or higher, and more preferably 35° C. or higher, from the viewpoint of improving storage stability and hot offset resistance of a toner, and improving image quality reliability on durability printing. In addition, the polyester A has a softening point of 55° C. or lower, preferably 50° C. or lower, and more preferably 45° C. or lower, from the viewpoint of improving low-temperature fixing ability and cold offset resistance of a toner. In other words, from these viewpoints taken together, the polyester A has a glass transition temperature of from 30° to 55° C., preferably from 33° to 50° C., and more preferably from 35° to 45° C.

On the other hand, the polyester B has a glass transition temperature of exceeding 55° C., preferably 57° C. or higher, and more preferably 60° C. or higher, from the viewpoint of improving storage stability and hot offset resistance of a toner, and improving image quality reliability on durability printing. In addition, the polyester B has a softening point of 80° C. or lower, preferably 75° C. or lower, and more preferably 70° C. or lower, from the viewpoint of improving low-temperature fixing ability and cold offset resistance of a toner. In other words, from these viewpoints taken together, the polyester B has a glass transition temperature of exceeding 55° C. and 80° C. or lower, preferably from 57° to 75° C., and more preferably from 60° to 70° C.

The difference in the glass transition temperatures of the polyester A and the polyester B is preferably 5° C. or more, more preferably 10° C. or more, and even more preferably 15° C. or more, from the viewpoint of improving low-temperature fixing ability and cold offset resistance of a toner. In addition, the difference in the glass transition temperatures is preferably 40° C. or less, more preferably 35° C. or less, and even more preferably 30° C. or less, from the viewpoint of improving dispersibility of a colorant or a charge control agent in the resin binder and improving image quality reliability on durability printing. In other words, from these viewpoints taken together, the difference in the glass transition temperatures of the polyester A and the polyester B is preferably from 5° to 40° C., more preferably from 10° to 35° C., and even more preferably from 15° to 30° C.

The glass transition temperature of the polyester can be controlled, for example, by the composition of the raw material monomers. For instance, the glass transition temperature can be elevated by decreasing the amount of a substituted succinic acid of which substituent is an alkyl group having 1 to 20 carbon atoms or an alkenyl group having 2 to 20 carbon atoms. Also, the glass transition temperature can be lowered by using a divalent raw material monomer having a large number of carbon atoms, for example, 6 or more carbon atoms, or a monovalent raw material monomer.

Also, the polyester A has a storage modulus at 150° C. of preferably 100 Pa or more, more preferably 300 Pa or more, and even more preferably 500 Pa or more, from the viewpoint of improving hot offset resistance of a toner, improving image quality reliability on durability printing and improving dispersibility of a colorant or a charge control agent in the resin binder. In addition, the polyester A has a storage modulus at 150° C. of preferably 3000 Pa or less, more preferably 2500 Pa or less, and even more preferably 2000 Pa or less, from the viewpoint of improving low-temperature fixing ability and cold offset resistance of a toner. In other words, from these viewpoints taken together, the polyester A has a storage modulus at 150° C. of preferably from 100 to 3000 Pa, more preferably from 300 to 2500 Pa, and even more preferably from 500 to 2000 Pa.

On the other hand, the polyester B has a storage modulus at 150° C. of preferably 2500 Pa or more, more preferably 3000 Pa or more, and even more preferably 3500 Pa or more, from the viewpoint of improving hot offset resistance and image quality reliability on durability printing of a toner. In addition, the polyester B has a storage modulus at 150° C. of preferably 20000 Pa or less, more preferably 15000 Pa or less, and even more preferably 10000 Pa or less, from the viewpoint of improving low-temperature fixing ability and cold offset resistance of a toner, and improving dispersibility of a colorant or a charge control agent in the resin binder. In other words, from these viewpoints taken together, the polyester B has a storage modulus at 150° C. of preferably from 2500 to 20000 Pa, more preferably from 3000 to 15000 Pa, even more preferably from 3500 to 10000 Pa.

The proportion of the storage moduli at 150° C. of the polyester B to the polyester A, i.e. the storage modulus of the polyester B/the storage modulus of the polyester A, is preferably 100 or less, more preferably 50 or less, and even more preferably 30 or less, from the viewpoint of increasing dispersibility of a colorant or the like in the polyester.

The storage modulus of the polyester can be raised, for example, by extending the reaction time for formation of polyester, or by using a trivalent or higher polyvalent raw material monomer. Also, the storage modulus can be lowered by using a monovalent raw material monomer.

The polyester is obtained by using as raw material monomers an alcohol component containing a dihydric or higher polyhydric alcohol and a carboxylic acid component containing a dicarboxylic or higher polycarboxylic acid compound, and polycondensing these components.

The dihydric alcohol includes diols having 2 to 20 carbon atoms, and preferably 2 to 15 carbon atoms, an alkylene oxide adduct of bisphenol A represented by the formula (I):

(I)

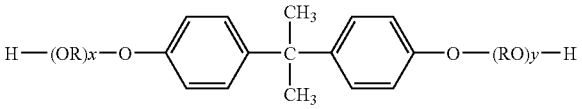

wherein each of RO and OR is an oxyalkylene group, wherein R is an ethylene group and/or a propylene group; x and y are number of moles of alkylene oxides added, each being a positive number, wherein an average of the sum of x and y is preferably from 1 to 16, more preferably from 1 to 8, and even more preferably from 1.5 to 4; and the like. Specifically, a dihydric alcohol having 2 to 20 carbon atoms includes ethylene glycol, propylene glycol, 1,6-hexanediol, bisphenol A, hydrogenated bisphenol A, and the like.

The alcohol component is preferably an alkylene oxide adduct of bisphenol A represented by the formula (I) from the viewpoint of improving image quality reliability on durability printing of a toner. The alkylene oxide adduct of bisphenol A represented by the formula (I) is contained in an amount of preferably 50% by mol or more, more preferably 70% by mol or more, and even more preferably 90% by mol or more of the alcohol component.

The trihydric or higher polyhydric alcohol includes trihydric or polyhydric alcohols having 3 to 20 carbon atoms, and preferably 3 to 10 carbon atoms, and the like. Specifically, the trihydric or polyhydric alcohol includes sorbitol, 1,4-sorbitan, pentaerythritol, glycerol, trimethylolpropane, and the like.

The dicarboxylic acid compound includes dicarboxylic acids having 3 to 30 carbon atoms, preferably 3 to 20 carbon atoms, and more preferably 3 to 10 carbon atoms; and derivatives such as acid anhydrides thereof and alkyl(1 to 12 carbon atoms) esters of those acids; and the like. Specifically, the dicarboxylic acid compound includes phthalic acid, isophthalic acid, terephthalic acid, fumaric acid, maleic acid, adipic acid; substituted succinic acids of which substituent is an alkyl group having 1 to 20 carbon atoms or an alkenyl group having 2 to 20 carbon atoms; and the like.

The tricarboxylic or higher polycarboxylic acid compound includes tricarboxylic or higher dicarboxylic acids having 4 to 30 carbon atoms, preferably 4 to 20 carbon atoms, and more preferably 4 to 10 carbon atoms; acid anhydrides thereof and alkyl(1 to 12 carbon atoms) esters of those acids; and the like. Specifically, the tricarboxylic or higher polycarboxylic acid compound includes 1,2,4-benzenetricarboxylic acid (trimellitic acid), and the like.

As the carboxylic acid compound, a substituted succinic acid of which substituent is an alkyl group having 1 to 20 carbon atoms or an alkenyl group having 2 to 20 carbon atoms is preferably used, a substituted succinic acid of which substituent is an alkyl group having 6 to 20 carbon atoms or an alkenyl group having 6 to 20 carbon atoms is more preferably used, and a substituted succinic acid of which substituent is an alkyl group having 8 to 16 carbon atoms or an alkenyl group having 8 to 16 carbon atoms is even more preferably used, from the viewpoint of lowering the glass transition temperature of the polyester and improving low-temperature fixing ability and cold offset resistance of a toner.

Therefore, the carboxylic acid component of the polyester A preferably contains a substituted succinic acid of which substituent is the above alkyl group or alkenyl group. The substituted succinic acid of which substituent is the above alkyl group or alkenyl group is contained in an amount of preferably 16% by mol or more, more preferably 18% by mol or more, and even more preferably 20% by mol or more of a total amount of the raw material monomers, in other words, a total amount of the carboxylic acid component and the alcohol component. In addition, the substituted succinic acid is contained in an amount of preferably 50% by mol or less, more preferably 45% by mol or less, and even more preferably 40% by mol or less, from the viewpoint of improving storage stability and hot offset resistance of a toner, and improving image quality reliability on durability printing. In other words, from these viewpoints taken together, the substituted succinic acid of which substituent is the above alkyl group or alkenyl group is contained in an amount of preferably from 16 to 50% by mol, more preferably from 18 to 45% by mol, and even more preferably from 20 to 40% by mol of a total amount of the raw material monomers for the polyester A.

On the other hand, in the carboxylic acid component of the polyester B, the substituted succinic acid of which substituent is the above alkyl group or alkenyl group is contained in an amount of preferably less than 16% by mol, more preferably 13% by mol or less, and even more preferably 12% by mol or less of a total amount of the raw material monomers, from the viewpoint of elevating the glass transition temperature of the polyester and improving hot offset resistance of a toner. In addition, the substituted succinic acid is contained in an amount of preferably 1% by mol or more, more preferably 2% by mol or more, and even more preferably 5% by mol or more, from the viewpoint of improving low-temperature fixing ability, cold offset resistance and image quality reliability on durability printing of a toner. In other words, from these viewpoints taken together, the substituted succinic acid of which substituent is the above alkyl group or alkenyl group is contained in an amount of preferably 1% by mol or more and less than 16% by mol, more preferably from 2 to 13% by mol, and even more preferably from 5 to 12% by mol of a total amount of the raw material monomers for the polyester B.

The polyester can be prepared by, for example, polycondensing an alcohol component and a carboxylic acid component in an inert gas atmosphere at a temperature of from 180° to 250° C. or so, in the presence of, as occasion demands, an esterification catalyst, a polymerization inhibitor, or the like. The esterification catalyst includes esterification catalysts such as tin compounds such as dibutyltin oxide and tin(II) 2-ethylhexanoate; titanium compounds such as titanium diisopropylate bis(triethanolaminate); and the like. The amount of the esterification catalyst used is preferably from 0.01 to 1 part by weight, and more preferably from 0.1 to 0.6 parts by weight, based on 100 parts by weight of a total amount of the alcohol component.

Here, in the present invention, the polyester may be a modified polyester to an extent that its properties are not substantially impaired. The modified polyester refers to a polyester grafted or blocked with phenol, urethane, epoxy, or the like, in accordance with the methods described in, for example, JP-A-Hei-11-133668, JP-A-Hei-10-239903, JP-A-Hei-8-20636, and the like.

The polyester A and the polyester B have an acid value of preferably 20 mg KOH/g or less, more preferably 15 mg KOH/g or less, and even more preferably 10 mg KOH/g or less, from the viewpoint of positive chargeability of a toner. Also, the polyester A and the polyester B have a hydroxyl value of preferably from 1 to 80 mg KOH/g, more preferably from 5 to 60 mg KOH/g, and even more preferably from 10 to 55 mg KOH/g.

The polyester A and the polyester B in the resin binder are in a weight ratio, i.e. the polyester A/the polyester B, of preferably from 20/80 to 99/1, more preferably from 30/70 to 99/1, and even more preferably from 40/60 to 99/1, from the viewpoint of improving low-temperature fixing ability and cold offset resistance of a toner. Also, the polyester A and the polyester B in the resin binder are in a weight ratio of preferably from 1/99 to 80/20, more preferably from 1/99 to 70/30, and even more preferably from 1/99 to 50/50, from the viewpoint of improving hot offset resistance. Therefore, the polyester A and the polyester B in the resin binder are in a weight ratio of preferably from 20/80 to 80/20, more preferably from 30/70 to 50/50, and even more preferably from 40/60 to 50/50, from the viewpoint of widening a fixing temperature region.

The resin binder may contain a resin binder other than the polyester A and the polyester B to an extent within the range that would not impair the effects of the present invention. The polyester A and the polyester B are contained in a total amount of preferably 80% by weight or more, more preferably 90% by weight or more, and even more preferably 100% by weight, of the resin binder. The resin binder other than the polyester A and the polyester B includes polyesters other than the polyester A and the polyester B, vinyl resins, epoxy resins, polycarbonates, polyurethanes, and the like, and polyesters other than the polyester A and the polyester B are preferred from the viewpoint of improving low-temperature fixing ability.

In the entire polyester, i.e. polyesters including the polyester A, the polyester B, and a polyester other than the polyester A and the polyester B, in the resin binder, the substituted succinic acid of which substituent is an alkyl group having 1 to 20 carbon atoms or an alkenyl group having 2 to 20 carbon atoms is contained in an amount of preferably 10% by weight or more, more preferably 15% by weight or more, and even more preferably 20% by weight or more, of a total amount of the raw material monomers for each of the polyesters, in other words, a total amount of the carboxylic acid component and the alcohol component, from the viewpoint of improving low-temperature fixing ability of a toner. In addition, the substituted succinic acid is contained in an amount of preferably 35% by weight or less, more preferably 30% by weight or less, and even more preferably 25% by weight or less, from the viewpoint of improving storage stability and hot offset resistance of a toner. In other words, from these viewpoints taken together, the substituted succinic acid of which substituent is the above alkyl group or alkenyl group is contained in an amount of preferably from 10 to 35% by weight, more preferably from 15 to 30% by weight, and even more preferably from 20 to 25% by weight.

In addition, the substituted succinic acid of which substituent is an alkyl group having 1 to 20 carbon atoms or an alkenyl group having 2 to 20 carbon atoms is contained in an amount of preferably from 5.0 to 30.0% by mol, more preferably from 10.0 to 18.5% by mol, and even more preferably from 15.0 to 17.5% by mol of the total amount of the raw material monomers for the entire polyester in the resin binder, from the viewpoint of improving image quality reliability on durability printing.

The toner of the present invention contains at least a colorant and a charge control agent, in addition to the resin binder.

As the colorant, all of dyes, pigments, and the like which are used as colorants for a toner can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazoyellow, and the like can be used. The colorant is contained in an amount of preferably from 1 to 40 parts by weight, and more preferably from 2 to 10 parts by weight, based on 100 parts by weight of the resin binder. The toner of the present invention may be any of black toners and color toners.

The charge control agent is not particularly limited. The negatively chargeable charge control agent includes metal-containing azo dyes, for example, "BONTRON S-28" (commercially available from Orient Chemical Co., Ltd.), "T-77" (commercially available from Hodogaya Chemical Co., Ltd.), "BONTRON S-34" (commercially available from Orient Chemical Co., Ltd.), "AIZEN SPILON BLACK TRH" (commercially available from Hodogaya Chemical Co., Ltd.), and the like; copper phthalocyanine dyes; metal complexes of alkyl derivatives of salicylic acid, for example, "BONTRON E-81," "BONTRON E-84," "BONTRON E-304" (hereinabove commercially available from Orient Chemical Co., Ltd.), and the like; nitroimidazole derivatives; boron complexes of benzilic acid, for example, "LR-147" (commercially available from Japan Carlit, Ltd.), and the like; nonmetal-based charge control agents, for example, "BONTRON F-21," "BONTRON E-89" (hereinabove commercially available from Orient Chemical Co., Ltd.), "T-8" (commercially available from Hodogaya Chemical Co., Ltd.), "FCA-2521NJ," "FCA-2508N" (hereinabove commercially available from Fujikura Kasei Co., Ltd.); and the like.

The negatively chargeable charge control agent is contained in an amount of preferably 0.1 parts by weight or more, and more preferably 0.2 parts by weight or more, based on 100 parts by weight of the resin binder, from the viewpoint of adjusting triboelectric charges of a toner to an appropriate level, thereby improving the developability. Also, the negatively chargeable charge control agent is contained in an amount of preferably 5 parts by weight or less, and more preferably 3 parts by weight or less, based on 100 parts by weight of the resin binder, from the viewpoint of preventing background fogging. In other words, from these viewpoints taken together, the negatively chargeable charge control agent is contained in an amount of preferably from 0.1 to 5 parts by weight, and more preferably from 0.2 to 3 parts by weight, based on 100 parts by weight of the resin binder.

The positively chargeable charge control agent includes non-polymer type positively chargeable charge control agents such as Nigrosine dyes, for example, "Nigrosine Base EX," "Oil Black BS," "Oil Black SO," "BONTRON N-01," "BONTRON N-07," "BONTRON N-09," "BONTRON N-11" (hereinabove commercially available from Orient Chemical Co., Ltd.), and the like; triphenylmethane-based dyes containing a tertiary amine as a side chain; quaternary ammonium salt compounds, for example, "BONTRON P-51," "BONTRON P-52" (hereinabove commercially available from Orient Chemical Co., Ltd.), "TP-415" (commercially available from Hodogaya Chemical Co., Ltd.), cetyltrimethylammonium bromide, "COPY CHARGE PX VP435" (commercially available from Clariant GmbH), and the like; and imidazole derivatives, for example, "PLZ-2001," "PLZ-8001" (hereinabove commercially available from Shikoku Kasei K.K.), and the like; and polymer type positively chargeable charge control agents (hereinafter referred to as "positively chargeable charge control resin"), such as polyamine resins, for example, "AFP-B" (commercially available from Orient Chemical Co., Ltd.), and the like; styrene-acrylic resins, for example, "FCA-201 PS" (hereinabove commercially available from Fujikura Kasei Co., Ltd.); and the like.

The positively chargeable charge control agent is contained in an amount of preferably 0.3 parts by weight or more, more preferably 1 part by weight or more, and even more preferably 2 parts by weight or more, based on 100 parts by weight of the resin binder, from the viewpoint of adjusting triboelectric charges of a toner to an appropriate level, thereby improving the developability. Also, the positively chargeable charge control agent is contained in an amount of preferably 20 parts by weight or less, more preferably 18 parts by weight or less, and even more preferably 15 parts by weight or less, based on 100 parts by weight of the resin binder, from the viewpoint of preventing background fogging. In other words, from these viewpoints taken together, the positively chargeable charge control agent is contained in an amount of preferably from 0.3 to 20 parts by weight, more preferably from 1 to 18 parts by weight, and even more preferably from 2 to 15 parts by weight, based on 100 parts by weight of the resin binder.

The non-polymer type positively chargeable charge control agent is contained in an amount of preferably from 0.3 to 10 parts by weight, more preferably from 1 to 8 parts by weight, even more preferably from 2 to 7 parts by weight, and even more preferably from 3 to 6 parts by weight, based on 100 parts by weight of the resin binder, from the viewpoint of giving the toner triboelectric chargeability, thereby preventing background fogging, and improving solid image quality.

Also, the positively chargeable charge control resin is contained in an amount of preferably from 1 to 20 parts by weight, more preferably from 2 to 15 parts by weight, even more preferably from 3 to 12 parts by weight, and even more preferably from 5 to 10 parts by weight, based on 100 parts by weight of the resin binder, from the viewpoint of giving the toner triboelectric chargeability, thereby preventing background fogging, and improving solid image quality.

The non-polymer type positively chargeable charge control agent and the positively chargeable charge control resin may be used together. In that case, the non-polymer type positively chargeable charge control agent is contained in an amount of preferably from 0.3 to 10 parts by weight, more preferably from 1 to 8 parts by weight, even more preferably from 2 to 7 parts by weight, and even more preferably from 3 to 6 parts by weight, based on 100 parts by weight of the resin binder, from the same viewpoints as above. Also, the positively chargeable charge control resin is contained in an amount of preferably from 1 to 20 parts by weight, more preferably from 2 to 15 parts by weight, even more preferably from 3 to 12 parts by weight, and even more preferably from 5 to 10 parts by weight, based on 100 parts by weight of the resin binder, from the same viewpoints as above. The non-polymer type positively chargeable charge control agent and the positively chargeable charge control resin are contained in a total amount of preferably from 1 to 20 parts by weight, more preferably from 2 to 18 parts by weight, even more preferably from 3 to 15 parts by weight, and even more preferably from 5 to 12 parts by weight, based on 100 parts by weight of the resin binder, from the same viewpoints as above.

Further, in a positively chargeable toner, although a negatively chargeable charge control agent may be used together within the range that would not impair the positive chargeability of the toner, it is preferable that a negatively chargeable charge control agent is not contained, or if contained, the negatively chargeable charge control agent is contained in an amount of preferably 1 part by weight or less, and more preferably 0.5 parts by weight or less, based on 100 parts by weight of the resin binder.

It is preferable that the toner of the present invention further contains an amide compound from the viewpoint of improving image quality reliability on durability printing.

The amide compound in the present invention is preferably an amide compound having 10 to 70 carbon atoms, more preferably an amide compound having 20 to 60 carbon atoms, and even more preferably an amide compound having 30 to 50 carbon atoms, from the viewpoint of improving image quality reliability on durability printing. The amide compound in the present invention includes fatty acid amide compounds and aromatic amide compounds, among which the fatty acid amide compounds are preferred from the viewpoint of improving image quality reliability on durability printing. The fatty acid moiety in the fatty acid amide compounds has preferably 6 to 30 carbon atoms, more preferably 12 to 24 carbon atoms, and more preferably 16 to 22 carbon atoms. Also, the amide compound in the present invention includes monoamide compounds, bisamide compounds, and polyamide compounds, among which bisamide compounds are preferred from the same viewpoints as above. Therefore, fatty acid bisamide compounds are more preferred.

The fatty acid amide compound preferably used in the present invention includes fatty acid monoamide compounds such as lauric acid amide, stearic acid amide, and hydroxystearic acid amide; and fatty acid bisamide compounds such as ethylenebis(lauric acid amide), ethylenebis(stearic acid amide), ethylenebis(hydroxystearic acid amide), hexamethylenebis(lauric acid amide), and hexamethylenebis(stearic acid amide). Among them, stearic acid amide, hydroxystearic acid amide, ethylenebis(stearic acid amide) and ethylenebis (hydroxystearic acid amide) are preferred, and ethylenebis (stearic acid amide) and ethylenebis(hydroxystearic acid amide) are more preferred.

The amide compound has a melting point of preferably from 70° to 200° C., and more preferably from 90° to 180° C., from the viewpoint of improving image quality reliability on durability printing of a toner. In addition, the amide compound has a molecular weight of preferably from 100 to 2000, more preferably from 250 to 1000, and even more preferably from 500 to 700, from the same viewpoint as above.

The amide compound is contained in an amount of preferably from 1 to 5 parts by weight, and more preferably from 2 to 4 parts by weight, based on 100 parts by weight of the resin binder.

It is preferable that the toner of the present invention further contains a releasing agent from the viewpoint of improving high-temperature and cold offset resistance, and widening a fixing temperature range.

The releasing agent includes aliphatic hydrocarbon waxes such as low-molecular weight polypropylenes, low-molecular weight polyethylenes, low-molecular weight polypropylene-polyethylene copolymers, microcrystalline waxes, paraffinic waxes, and Fischer-Tropsch wax, and oxides thereof; ester waxes such as carnauba wax, montan wax, and sazole wax, deacidified waxes thereof, and fatty acid ester waxes; fatty acids, higher alcohols, metal salts of fatty acids, and the like. These waxes may be used alone or in a mixture of two or more kinds.

The releasing agent has a melting point of preferably from 60° to 160° C., and more preferably from 60° to 150° C., from the viewpoint of low-temperature fixing ability, and high-temperature and cold offset resistance of a toner.

The releasing agent is contained in an amount of preferably from 0.5 to 10 parts by weight, more preferably from 1 to 8 parts by weight, and even more preferably from 1.5 to 7 parts by weight, based on 100 parts by weight of the resin binder, from the viewpoint of dispersibility in the resin binder.

The toner of the present invention may further properly contain an additive such as a magnetic powder, a fluidity improver, an electric conductivity modifier, an extender, a reinforcing filler such as a fibrous substance, an antioxidant, an anti-aging agent and a cleanability improver.

The toner of the present invention may be a toner obtained by any of conventionally known methods such as a melt-kneading method, an emulsion phase-inversion method, and a polymerization method, and a pulverized toner produced by the melt-kneading method is preferred, from the viewpoint of productivity and colorant dispersibility. Specifically, the toner can be produced by homogeneously mixing raw materials such as a resin binder, a colorant, a charge control agent and a releasing agent with a mixer such as a Henschel mixer, thereafter melt-kneading the mixture with a closed kneader, a single-screw or twin-screw extruder, an open roller-type kneader, or the like, cooling, pulverizing, and classifying the product. On the other hand, a toner produced by the polymerization method is preferred from the viewpoint of the production of toners having smaller particle sizes.

The toner has a volume-median particle size ($D_{50}$) of preferably from 3.0 to 11 μm, more preferably from 3.5 to 9 μm, and even more preferably from 4 to 8 μm, from the viewpoint of reducing toner consumption and from the viewpoint of improving image quality.

The toner has a softening point of preferably 115° C. or higher, more preferably 120° C. or higher, and even more preferably 125° C. or higher, from the viewpoint of lowering gloss of a black toner. Also, the toner has a softening point of preferably 155° C. or lower, more preferably 150° C. or lower, even more preferably 145° C. or lower, from the viewpoint of improving fixing strength of a toner. In other words, from these viewpoints taken together, toner has a softening point of preferably from 115° to 155° C., more preferably from 120° to 150° C., and even more preferably from 125° to 145° C.

The toner has a glass transition temperature of preferably 30° C. or higher, more preferably 35° C. or higher, and even more preferably 40° C. or higher, from the viewpoint of improving storage stability and hot offset resistance of a toner, and from the viewpoint of improving image quality reliability on durability printing. Also, the toner has a glass transition temperature of preferably 65° C. or lower, more preferably 60° C. or lower, and even more preferably 55° C. or lower, from the viewpoint of improving low-temperature fixing ability and cold offset resistance of a toner. In other words, from these viewpoints taken together, the toner has a glass transition temperature of preferably from 30° to 65° C., more preferably from 35° to 60° C., and even more preferably from 40° to 55° C.

The toner of the present invention may be a toner produced by a method further including the step of mixing toner matrix particles after the pulverizing and classifying steps with an external additive such as the above-mentioned fine inorganic particles or fine resin particles made of polytetrafluoroethylene.

In the mixing of the toner matrix particles obtained after the pulverizing and classifying steps with an external additive, an agitator having an agitation member such as rotary impellers is preferably used, and a more preferred agitator includes a Henschel mixer.

The toner of the present invention can be either directly used as a monocomponent toner in an apparatus for forming fixed images of a monocomponent development, or used as a two-component developer containing the toner mixed with a carrier in an apparatus for forming fixed images of a two-component development.

The positively chargeable toner of the present invention is used in an apparatus for forming fixed images for a positively chargeable toner. Particularly, the positively chargeable toner of the present invention is preferably used in an apparatus for forming fixed images comprising a cleaner-less development system because the toner has excellent triboelectric chargeability and excellent transferability. Therefore, the present invention can provide a method for forming fixed images using the above toner, and an apparatus for forming fixed images for a positively chargeable toner, in particular, an apparatus for forming fixed images for a positively chargeable toner which comprises a cleaner-less development system.

EXAMPLES

The following examples further describe and demonstrate embodiments of the present invention. The examples are given solely for the purposes of illustration and are not to be construed as limitations of the present invention.

[Softening Points (Tm) of Resins and Toners]

The softening point refers to a temperature at which half of the sample flows out, when plotting a downward movement of a plunger of a flow tester (commercially available from Shimadzu Corporation, CAPILLARY RHEOMETER "CFT-500D"), against temperature, in which a sample is prepared by applying a load of 1.96 MPa thereto with the plunger and extruding a 1 g sample through a nozzle having a die pore size of 1 mm and a length of 1 mm, while heating the sample so as to raise the temperature at a rate of 6° C./min.

[Glass Transition Temperatures (Tg) of Resins and Toners]

The glass transition temperature refers to a temperature of an intersection of the extension of the baseline of equal to or lower than the temperature of the maximum endothermic peak and the tangential line showing the maximum inclination between the kick-off of the peak and the top of the peak, which is determined using a differential scanning calorimeter ("DSC 210," commercially available from Seiko Instruments, Inc.), by weighing 0.01 to 0.02 g of a sample in an aluminum pan, raising the temperature of the sample to 200° C., cooling the sample from this temperature to −10° C. at a cooling rate of 10° C./min, and thereafter raising the temperature of the sample at a heating rate of 10° C./min.

[Acid Values of Resins]

The acid values are measured as prescribed by a method of JIS K0070, provided that only a measurement solvent is changed from a mixed solvent of ethanol and ether as prescribed in JIS K0070 to a mixed solvent of acetone and toluene (acetone:toluene=1:1 (volume ratio)).

[Hydroxyl Values of Resins]

The hydroxyl values are measured as prescribed by a method of JIS K0070.

[Storage Modulus (G') of Resins]

The storage modulus is measured using a viscoelastometer (rheometer) ARES (commercially available from TA Instruments, Japan) (strain: 0.05%, frequency: 6.28 rad/sec). The conditions of the measurement apparatus are set as follows. Parallel plates each having a diameter of 25 mm are heated to 140° C. and allowed to stand, and a sample is placed on the parallel plates while melting the sample at 140° C. so as to adjust a gap therebetween to 1.5 to 2.5 mm to sandwich the sample with the upper and lower plates. Thereafter, the sample is cooled to 30° C. at a rate of 20° C./min, and thereafter heated to 180° C. at a rate of 5° C./min to obtain a storage modulus at 150° C. Specifically, the measurement apparatus is set as follows.

AutoTension Adjustment=On
Mode=Apply Constant Static Force
AutoTension Direction=Compression
Initial Static Force=10.0 [g]
AutoTension Sensitivity=10.0 [g]
When Sample Modulus<=100.0 [Pa]
AutoTension Limits=Default
Max Autotension Displacement=3.0 [mm]
Max Autotension Rate=0.01 [mm/s]
AutoStrain=On
Max Applied Strain=20.0[%]
Max Allowed Torque=300.0 [g-cm]
Min Allowed Torque=1.0 [g-cm]
Strain Adjustment=20.0[% of Current Strain]
Strain Amplitude Control=Default Behavior
Limit Minimum Dynamic Force Used=No
Minimum Applied Dynamic Force=1.0 [gmf]

[Melting Points of Amide Compounds]

The melting points of the amide compounds are obtained from temperatures of endothermic peaks attributable to crystal fusion according to a heating method of differential scanning calorimetry (DSC) as prescribed in JIS K7121.

[Melting Points of Releasing Agents]

A temperature of maximum endothermic peak of the heat of fusion obtained by raising the temperature of a sample to 200° C. using a differential scanning calorimeter ("DSC 210," commercially available from Seiko Instruments, Inc.), cooling the sample from this temperature to 0° C. at a cooling rate of 10° C./min, and thereafter raising the temperature of the sample at a heating rate of 10° C./min, is referred to as a melting point.

[Volume-Median Particle Size ($D_{50}$) of Toners]

Measuring Apparatus: Coulter Multisizer II (commercially available from Beckman Coulter, Inc.)

Aperture Diameter: 50 μm

Analyzing Software: Coulter Multisizer AccuComp Ver. 1.19 (commercially available from Beckman Coulter, Inc.)

Electrolytic Solution: "Isotone II" (commercially available from Beckman Coulter, Inc.)

Dispersion: "EMULGEN 109P" (commercially available from Kao Corporation, polyoxyethylene lauryl ether, HLB: 13.6) is dissolved in the above electrolytic solution so as to have a concentration of 5% by weight to provide a dispersion.

Dispersion Conditions: Ten milligrams of a measurement sample is added to 5 ml of the above dispersion, and the mixture is dispersed for 1 minute with an ultrasonic disperser, and 25 ml of an electrolytic solution is added to the dispersion, and further dispersed with an ultrasonic disperser for 1 minute, to prepare a sample dispersion.

Measurement Conditions: The above sample dispersion is added to 100 ml of the above electrolytic solution to adjust to a concentration at which particle sizes of 30,000 particles can be measured in 20 seconds, and thereafter the 30,000 particles are measured, and a volume-median particle size ($D_{50}$) is obtained from the particle size distribution.

Production Example 1 for Resins

A 10-liter four-neck flask equipped with a nitrogen inlet tube, a dehydration tube, a stirrer, and a thermocouple was charged with raw material monomers listed in Table 1 other than tetrapropenyl succinic anhydride and trimellitic anhydride, and 20 g of tin(II) 2-ethylhexanoate as an esterification catalyst, and the components were heated to 240° C. under a nitrogen atmosphere and allowed to react at that temperature for 5 hours, and then allowed to react at 8.3 kPa for 1 hour. Thereafter, tetrapropenyl succinic anhydride and trimellitic anhydride were supplied to the reaction mixture, allowed to react at a normal pressure for 1 hour, and then allowed to react at 8.3 kPa. The reaction was terminated at a point where a desired softening point was attained, to provide each of the polyesters (Resins A1 to A5) having physical properties shown in Table 1.

Production Example 2 for Resins

A 10-liter four-neck flask equipped with a nitrogen inlet tube, a dehydration tube, a stirrer, and a thermocouple was charged with raw material monomers listed in Table 1 other than trimellitic anhydride, and 20 g of tin(II) 2-ethylhexanoate as an esterification catalyst, and the components were allowed to react at 235° C. under a nitrogen atmosphere for 5 hours, and then allowed to react at 8.3 kPa for 1 hour. Thereafter, trimellitic anhydride was supplied to the reaction mixture, and the mixture was allowed to react at a normal pressure for 1 hour, and then allowed to react at 8.3 kPa. The reaction was terminated at a point where a desired softening point was attained, to provide each of the polyesters (Resins B1 to B3 and Resins C1 to C3) having physical properties shown in Table 1.

TABLE 1

| | Raw Material Monomers | | | | | Amount of Succinic Acid in Raw Material Monomers (% by mol) | Physical Properties | | | | |
|---|---|---|---|---|---|---|---|---|---|---|---|
| | BPA-PO[1)] | BPA-EO[2)] | Tetra-propenyl Succinic Anhydride | Terephthalic Acid | Trimellitic Anhydride | | Tm (° C.) | Tg (° C.) | Acid Value (mgKOH/g) | Hydroxyl Value (mgKOH/g) | G' [150° C.] (Pa) |
| Resin A1 | 1801 g (5.15 mol) | 718 g (2.21 mol) | 749 g (2.79 mol) | 390 g (2.35 mol) | 198 g (1.03 mol) | 20.6 | 122.8 | 48.5 | 5.9 | 34 | 560 |
| Resin A2 | 1801 g (5.15 mol) | 718 g (2.21 mol) | 749 g (2.79 mol) | 390 g (2.35 mol) | 198 g (1.03 mol) | 20.6 | 128.2 | 52.1 | 6.9 | 30 | 1420 |
| Resin A3 | 1801 g (5.15 mol) | 718 g (2.21 mol) | 985 g (3.68 mol) | 244 g (1.47 mol) | 198 g (1.03 mol) | 27.2 | 119.2 | 45.1 | 6.6 | 34 | 520 |
| Resin A4 | 1801 g (5.15 mol) | 718 g (2.21 mol) | 1379 g (5.15 mol) | — | 198 g (1.03 mol) | 38.0 | 124.0 | 39.6 | 5.5 | 25 | 820 |
| Resin A5 | 1801 g (5.15 mol) | 718 g (2.21 mol) | 749 g (2.79 mol) | 390 g (2.35 mol) | 198 g (1.03 mol) | 20.6 | 133.0 | 50.9 | 6.3 | 29 | 1810 |
| Resin B1 | 1801 g (5.15 mol) | 718 g (2.21 mol) | 433 g (1.62 mol) | 586 g (3.53 mol) | 226 g (1.18 mol) | 11.8 | 157.4 | 61.3 | 8.8 | 20 | 4300 |
| Resin B2 | 1801 g (5.15 mol) | 718 g (2.21 mol) | 98 g (0.37 mol) | 732 g (4.41 mol) | 226 g (1.18 mol) | 2.8 | 151.0 | 66.1 | 5.0 | 40 | 3840 |
| Resin B3 | 2573 g (7.35 mol) | — | — | 830 g (5.00 mol) | 198 g (1.03 mol) | 0 | 162.3 | 73.0 | 4.0 | 40 | 6960 |
| Resin C1 | 1801 g (5.15 mol) | 718 g (2.21 mol) | 236 g (0.88 mol) | 708 g (4.27 mol) | 198 g (1.03 mol) | 6.5 | 136.4 | 62.7 | 3.1 | 35 | 2200 |
| Resin C2 | 1801 g (5.15 mol) | 718 g (2.21 mol) | 236 g (0.88 mol) | 708 g (4.27 mol) | 198 g (1.03 mol) | 6.5 | 122.5 | 61.9 | 7.7 | 40 | 620 |
| Resin C3 | 1801 g (5.15 mol) | 718 g (2.21 mol) | 98 g (0.37 mol) | 671 g (4.04 mol) | 198 g (1.03 mol) | 2.9 | 90.5 | 49.8 | 6.0 | 50 | 1 |

[1)] Polyoxypropylene(2.2)-2,2-bis(4-hydroxyphenyl)propane

[2)] Polyoxyethylene(2.2)-2,2-bis(4-hydroxyphenyl)propane

Examples 1 to 15 and Comparative Examples 1 to 4

One-hundred parts by weight of resin binders listed in Table 2, 0.6 parts by weight of a positively chargeable charge control agent "BONTRON P-51" (commercially available from Orient Chemical Co., Ltd.), 4.0 parts by weight of a positively chargeable charge control agent "BONTRON N-04" (commercially available from Orient Chemical Co., Ltd.), 7.0 parts by weight of a positively chargeable charge control resin "FCA-201-PS" (commercially available from Fujikura Kasei Co., Ltd.), 6.0 parts by weight of a carbon black "REGAL 330R" (commercially available from Cabot Specialty Chemicals, Inc.), 2.0 parts by weight of a releasing agent "Mitsui Hi-wax NP055" (commercially available from MITSUI CHEMICALS, INC., melting point: 140° C.), 1.0 part by weight of a releasing agent "Sazole Wax SP105" (commercially available from S. Kato & CO., melting point: 117° C.), and optionally 3.0 parts by weight of an amide compound listed in Table 2, an amide compound not being added in Examples 14 and 15, were mixed together with a Henschel mixer while stirring for 1 minute. The resulting mixture was then melt-kneaded with a twin-screw kneader.

The resulting melt-kneaded mixture was pulverized and classified with an IDS pulverizer-classifier (commercially available from Nippon Pneumatic Mfg. Co., Ltd.), to provide positively chargeable toner matrix particles having a volume-median particle size ($D_{50}$) of 7.7 μm.

One hundred parts by weight of the resulting toner matrix particles were mixed with 0.35 parts by weight of a hydrophobic silica "TG-820F" (commercially available from Cabot Specialty Chemicals, Inc., number-average particle size: 8 nm), 1.0 part by weight of a hydrophobic silica "R-972" (commercially available from Nihon Aerosil Co., Ltd., number-average particle size: 16 nm), and 0.35 parts by weight of fine polytetrafluoroethylene particles "KTL-500F" (commercially available from KITAMURA LIMITED, number-average particle size: 500 nm) with a Henschel mixer for 3 minutes, to provide a toner.

TABLE 2

| | Resin Binders (Resin Nos.) (Parts by Weight) | | | | | | | | | | | Amount[1)] of Succinic Acid in Polyester | Amide Compound[2)] (Parts by Weight) | Difference in Physical Properties Between Resins | | | Physical Properties of Toner | |
|---|---|---|---|---|---|---|---|---|---|---|---|---|---|---|---|---|---|---|
| | A1 | A2 | A3 | A4 | A5 | B1 | B2 | B3 | C1 | C2 | C3 | (% by mol) | | Difference in Tm | Difference in Tg | G' Ratio | Tm (° C.) | Tg (° C.) |
| Ex. 1 | 30 | — | — | — | — | 70 | — | — | — | — | — | 14.4 | α(3) | 34.6 | 12.8 | 7.7 | 138.5 | 54.3 |
| Ex. 2 | 45 | — | — | — | — | 55 | — | — | — | — | — | 15.8 | α(3) | 34.6 | 12.8 | 7.7 | 136.0 | 54.2 |
| Ex. 3 | 60 | — | — | — | — | 40 | — | — | — | — | — | 17.1 | α(3) | 34.6 | 12.8 | 7.7 | 132.3 | 53.1 |
| Ex. 4 | 70 | — | — | — | — | 30 | — | — | — | — | — | 18.0 | α(3) | 34.6 | 12.8 | 7.7 | 126.0 | 49.4 |
| Ex. 5 | — | 45 | — | — | — | 55 | — | — | — | — | — | 15.8 | α(3) | 29.2 | 9.2 | 3.0 | 141.0 | 53.3 |
| Ex. 6 | — | — | 45 | — | — | 55 | — | — | — | — | — | 18.7 | α(3) | 38.2 | 16.2 | 8.3 | 135.0 | 49.1 |
| Ex. 7 | — | — | — | 45 | — | 55 | — | — | — | — | — | 23.6 | α(3) | 33.4 | 21.7 | 5.2 | 136.1 | 42.2 |
| Ex. 8 | — | — | — | — | 45 | 55 | — | — | — | — | — | 15.8 | α(3) | 24.4 | 10.4 | 2.4 | 141.9 | 52.9 |
| Ex. 9 | 45 | — | — | — | — | — | 55 | — | — | — | — | 10.8 | α(3) | 28.2 | 17.6 | 6.9 | 128.8 | 52.7 |
| Ex. 10 | 45 | — | — | — | — | — | — | 55 | — | — | — | 9.3 | α(3) | 39.5 | 24.5 | 12.4 | 136.3 | 54.2 |
| Ex. 11 | — | — | — | 40 | — | — | 60 | — | — | — | — | 16.9 | α(3) | 27.0 | 26.5 | 4.7 | 129.0 | 52.8 |
| Ex. 12 | 45 | — | — | — | — | 55 | — | — | — | — | — | 15.8 | β(3) | 34.6 | 12.8 | 7.7 | 132.4 | 45.8 |
| Ex. 13 | 45 | — | — | — | — | 55 | — | — | — | — | — | 15.8 | γ(3) | 34.6 | 12.8 | 7.7 | 135.4 | 50.1 |
| Ex. 14 | 45 | — | — | — | — | 55 | — | — | — | — | — | 15.8 | — | 34.6 | 12.8 | 7.7 | 136.2 | 55.5 |
| Ex. 15 | — | — | 45 | — | — | 55 | — | — | — | — | — | 18.7 | — | 38.2 | 16.2 | 8.3 | 135.5 | 51.0 |
| Comp. Ex. 1 | — | — | — | — | — | 64 | — | — | 36 | — | — | 9.9 | α(3) | 21.0 | 1.4 | 2.0 | 143.3 | 61.2 |
| Comp. Ex. 2 | — | — | — | — | — | 55 | — | — | — | 45 | — | 9.4 | α(3) | 34.9 | 0.6 | 6.9 | 127.5 | 60.9 |
| Comp. Ex. 3 | — | — | — | — | — | 60 | — | — | — | — | 40 | 8.2 | α(3) | 66.9 | 11.5 | 4300 | 128.5 | 52.3 |
| Comp. Ex. 4 | — | — | — | — | — | — | — | — | 40 | — | 60 | 4.3 | α(3) | 45.9 | 12.9 | 2200 | 118.6 | 53.4 |

[1)]Weighted average of the amount of a substituted succinic acid of which substituent is an alkyl group (C1-20) and alkenyl group (C2-20) in the polyester used Calculation method in the case of Example 1: 20.6 (Resin A1) × 0.3 + 11.8 (Resin B1) × 0.7 = 14.4

[2)]Amide Compound α: ethylenebis stearic acid amide "Kaowax EB-P" (commercially available from Kao Corporation, melting point: 144° C., molecular weight: 592) Amide Compound β: Stearic acid amide "Fatty Acid Amide T" (commercially available from Kao Corporation, melting point: 100° C., molecular weight: 283) Amide Compound γ: Ethylenebis hydroxystearic acid amide "SLIPACKS H" (commercially available from Nippon Kasei Chemical Co., Ltd., melting point: 145° C., molecular weight: 624)

Test Example 1

Low-Temperature Fixing Ability

A toner was loaded to a printer "HL-2040" commercially available from Brother Industries, modified so as to obtain an unfixed image, and an unfixed image which was a solid image of a square having a side of 2 cm was printed. Thereafter, this unfixed image was subjected to a fixing treatment at each temperature with an external fixing device, an modified device of an oilless fixing system "DL-2300" (commercially available from Konica Minolta Business Technologies, Inc.) (a device in which a fixing roller was set at a rotational speed of 265 mm/sec, and a fixing roller temperature in the fixing device was made variable), while raising the fixing roller temperatures from 100° to 230° C. in an increment of 5° C., to perform a solid image printing. A sand-rubber eraser to which a load of 500 g was applied was moved backward and forward five times over a fixed image obtained at each fixing temperature. The temperature of the fixing roller at which a ratio of image densities before and after rubbing, i.e. image densities after rubbing/before rubbing ×100, initially exceeds 90% is defined as a lowest fixing temperature, by which the low-temperature fixing ability was evaluated. The results are shown in Table 3.

Test Example 2

Offset Resistance

A toner was loaded to a printer "HL-2040" commercially available from

Brother Industries, modified so as to obtain an unfixed image, and an unfixed image which was a solid image of a square having a side of 2 cm was printed. Thereafter, this unfixed image was subjected to a fixing treatment at each temperature with an external fixing device, an modified device of an oilless fixing system "DL-2300" (commercially available from Konica Minolta Business Technologies, Inc.) (a device in which a fixing roller was set at a rotational speed of 265 mm/sec, and a fixing roller temperature in the fixing device was made variable), while raising the fixing roller temperatures from 100° to 230° C. in an increment of 5° C., to perform a solid image printing. After the solid image printing was performed at each temperature, a plain blank paper was subsequently allowed to pass through the fixing roller. A temperature at which offset image is generated on the plain blank paper before the offset image is no longer present is defined as a cold offset generating temperature. In addition, a temperature at which offset image is generated on the plain blank paper after further raising the temperature of the fixing roller is defined as a hot offset generating temperature. The results are shown in Table 3.

Test Example 3

Fixing Temperature Region

A fixing temperature region was obtained for each of the toners in Examples and Comparative Examples having lowest fixing temperatures of 145° C. or lower. A difference between (A) a temperature whichever that is higher of either (i) a temperature calculated from a cold offset generating temperature plus(+) 5° C. [a cold offset generating temperature+5° C.], or (ii) a lowest fixing temperature, and (B) a temperature calculated from a hot offset temperature minus (−) 5° C. [a hot offset generating temperature−5° C.] is defined as a fixing temperature region. The results are shown in Table 3.

Test Example 4

Triboelectric Charges

A toner was loaded to a printer "HL-2040" commercially available from Brother Industries equipped with a cleanerless development system, and full-page solid image printing was performed. Thereafter, the toner on the developer roller was aspirated in 10 locations with q/m meter "MODEL 210HS, commercially available from Trek Japan K. K.," and electric charges and a unit mass of the toner were measured to calculate triboelectric charges (μC/g). The results are shown in Table 3.

Test Example 5

Background Fogging

A toner was loaded to a printer "HL-2040" commercially available from Brother Industries equipped with a cleanerless development system, and fixed images having a print coverage of 1% were printed for 5,000 sheets under the conditions of a 20-second intermittence after each page. Blank images were printed every 1,000 sheets, and a power source was turned off during the course of printing. The toner on the photoconductor surface was adhered to a mending tape, and a coloration density was measured with an image densitometer "SPM-50" (commercially available from Gretag Corporation). A difference between the found coloration density and the coloration density of the tape before the toner adhesion was obtained, and an average of five coloration densities taken after 1,000 sheets and up to 5,000 sheets for every 1,000 sheets was calculated. Background fogging was evaluated in accordance with the following evaluation criteria. The results are shown in Table 3.

[Evaluation Criteria]

A: A difference in coloration densities is less than 0.08.

B: A difference in coloration densities is 0.08 or more and less than 0.13.

C: A difference in coloration densities is 0.13 or more and less than 0.15.

D: A difference in coloration densities is 0.15 or more.

Test Example 6

Solid Image Quality

A toner was loaded to a printer "HL-2040" commercially available from Brother Industries equipped with a cleanerless development system, and fixed images having a print coverage of 1% were printed for 10,000 sheets under the conditions of a 20-second intermittence after each page. During printing, solid images were printed every 1,000 sheets, and the resulting fixed images were visually observed, and evaluated for solid image quality in accordance with the following evaluation criteria. The results are shown in Table 3.

[Evaluation Criteria]

A: Solid image quality is excellent even after printing 10,000 sheets.

B: Solid image quality is lowered after printing 8,000 or more sheets.

C: Solid image quality is lowered after printing 5,000 or more sheets.

D: Solid image quality is lowered before printing 5,000 sheets.

Test Example 7

Image Quality Reliability on Durability Printing

A toner was loaded to a printer "HL-2040" commercially available from Brother Industries, and continuous printing was carried out at a print coverage of 0.1%. Dot patterns of 2 dots and 2 spaces were printed every 1,000 sheets, and image quality was visually confirmed to evaluate its reliability on durability printing. The image quality reliability on durability printing was evaluated using the number of printed sheets until which nonuniform image density or streak was generated as an index. The continuous printing was performed up to 30,000 sheets, and a case where the number of printed sheets was 15,000 or more sheets was evaluated as being acceptable. The results are shown in Table 3.

TABLE 3

| | Lowest Fixing Temp. (° C.) | Low-Temp. Offset Generating Temp. (° C.) | High-Temp. Offset Generating Temp. (° C.) | Fixing Temp. Region (° C.) | Tribo-electric Charges (μC/g) | Back-ground Fogging | Solid Image Quality | Image Quality Reliability on Durability Printing (sheets) |
|---|---|---|---|---|---|---|---|---|
| Ex. 1 | 145 | 140 | 230< | 85< | 41.0 | A | A | 23,000 |
| Ex. 2 | 140 | 130 | 230< | 90< | 42.0 | A | A | 30,000< |
| Ex. 3 | 140 | 135 | 220 | 75 | 43.3 | A | A | 26,000 |
| Ex. 4 | 140 | 135 | 220 | 75 | 42.8 | A | A | 21,000 |
| Ex. 5 | 145 | 140 | 230< | 85< | 44.1 | A | A | 28,000 |
| Ex. 6 | 140 | 135 | 230< | 90< | 41.1 | A | A | 18,000 |
| Ex. 7 | 135 | 130 | 230< | 95< | 42.5 | A | A | 15,000 |
| Ex. 8 | 145 | 140 | 230< | 85< | 43.2 | A | A | 27,000 |
| Ex. 9 | 140 | 135 | 230< | 90< | 41.0 | A | A | 21,000 |
| Ex. 10 | 145 | 140 | 230< | 85< | 41.6 | A | A | 17,000 |
| Ex. 11 | 145 | 140 | 230< | 85< | 43.1 | A | A | 27,000 |
| Ex. 12 | 135 | 130 | 230< | 95< | 41.8 | A | A | 24,000 |
| Ex. 13 | 135 | 130 | 230< | 95< | 42.1 | A | A | 25,000 |
| Ex. 14 | 145 | 140 | 230< | 85< | 41.5 | A | A | 19,000 |
| Ex. 15 | 140 | 135 | 230< | 90< | 42.5 | A | A | 15,000 |
| Comp. Ex. 1 | 160 | 155 | 230< | — | 44.9 | A | A | 30,000< |
| Comp. Ex. 2 | 160 | 155 | 230< | — | 40.7 | A | A | 30,000< |
| Comp. Ex. 3 | 145 | 140 | 220 | 70 | 21.5 | D | D | 9,000 |
| Comp. Ex. 4 | 140 | 135 | 190 | 45 | 21.8 | D | D | 7,000 |

It can be seen from the above results that the toners of Examples 1 to 15 have excellent low-temperature fixing ability and offset resistance, wide fixing temperature regions, inhibited filming on blades or the like, and excellent image quality reliability on durability printing, as compared to the toners of Comparative Examples 1 to 4. Further, it can be seen that the toners of Examples have prevented generation of background fogging and lowering of solid image quality.

Examples 16 and 17 and Comparative Examples 5 and 6

One-hundred parts by weight of resin binders listed in Table 4, 1.0 part by weight of a negatively chargeable charge control agent "T-77" (commercially available from Hodogaya Chemical Co., Ltd.), 4.0 parts by weight of a carbon black "MOGUL L" (commercially available from Cabot Specialty Chemicals, Inc.), 3.0 parts by weight of a releasing agent "Mitsui Hi-wax NP056" (commercially available from MITSUI CHEMICALS, INC., melting point: 125° C.), and optionally an amide compound listed in Table 4, an amide compound not being added in Example 17, were mixed with a Henschel mixer while stirring for 1 minute. The resulting mixture was then melt-kneaded with a twin-screw kneader.

The resulting melt-kneaded mixture was pulverized and classified with an IDS pulverizer-classifier (commercially available from Nippon Pneumatic Mfg. Co., Ltd.), to provide negatively chargeable toner matrix particles having a volume-median particle size ($D_{50}$) of 8.0 μm.

One hundred parts by weight of the resulting toner matrix particles were mixed with 0.35 parts by weight of a hydrophobic silica "R972" (commercially available from Nihon Aerosil Co., Ltd., number-average particle size: 16 nm), and 1.0 part by weight of a hydrophobic silica "RY-50" (commercially available from Nihon Aerosil Co., Ltd., number-average particle size: 40 nm) were mixed with a Henschel mixer for 3 minutes, to provide a toner.

TABLE 4

| | Resin Binders (Resin No.) (Parts by Weight) | | | | | | | | | | | Amount[1] of Succinic Acid in Polyester (% by mol) | Amide Compound[2] (Parts by Weight) | Difference in Physical Properties Between Resins | | | Physical Properties of Toner | |
|---|---|---|---|---|---|---|---|---|---|---|---|---|---|---|---|---|---|---|
| | A1 | A2 | A3 | A4 | A5 | B1 | B2 | B3 | C1 | C2 | C3 | | | Difference in Tm | Difference in Tg | G' Ratio | Tm (° C.) | Tg (° C.) |
| Ex. 16 | 45 | — | — | — | — | 55 | — | — | — | — | — | 15.8 | α(3) | 34.6 | 12.8 | 7.7 | 135.0 | 54.0 |
| Ex. 17 | 45 | — | — | — | — | 55 | — | — | — | — | — | 15.8 | — | 34.6 | 12.8 | 7.7 | 134.8 | 55.1 |
| Comp. Ex. 5 | — | — | — | — | — | 60 | — | — | — | — | 40 | 8.2 | α(3) | 66.9 | 11.5 | 4300 | 129.1 | 52.8 |
| Comp. Ex. 6 | — | — | — | — | — | — | — | — | 70 | — | 30 | 5.4 | α(3) | 45.9 | 12.9 | 2200 | 120.6 | 53.7 |

[1]Weighted average of the amount of a substituted succinic acid of which substituent is an alkyl group (C1-20) and alkenyl group (C2-20) in the polyester used Calculation method in the case of Example 16: 20.6 (Resin A1) × 0.45 + 11.8 (Resin B1) × 0.55 = 15.8

[2]Amide Compound α: ethylenebis stearic acid amide "Kaowax EB-P] (commercially available from Kao Corporation, melting point: 144° C., molecular weight: 592)

Test Example 8

Low-Temperature Fixing Ability

A toner was loaded to a printer "ML5400" commercially available from Oki Data Corporation, modified so as to obtain an unfixed image, and an unfixed image which was a solid image of a square having a side of 2 cm was printed. Thereafter, this unfixed image was subjected to a fixing treatment at each temperature with an external fixing device, an modified device of an oilless fixing system "DL-2300" (commercially available from Konica Minolta Business Technologies, Inc.) (a device in which a fixing roller was set at a rotational speed of 265 mm/sec, and a fixing roller temperature in the fixing device was made variable), while raising the fixing roller temperatures from 100° to 230° C. in an increment of 5° C., to perform a solid image printing. A sand-rubber eraser to which a load of 500 g was applied was moved backward and forward five times over a fixed image obtained at each fixing temperature. The temperature of the fixing roller at which a ratio of image densities before and after rubbing, i.e. image densities after rubbing/before rubbing ×100, initially exceeds 90% is defined as a lowest fixing temperature, by which the low-temperature fixing ability was evaluated. The results are shown in Table 5.

Test Example 9

Offset Resistance

A toner was loaded to a printer "ML5400" commercially available from Oki Data Corporation, modified so as to obtain an unfixed image, and an unfixed image which was a solid image of a square having a side of 2 cm was printed. Thereafter, this unfixed image was subjected to a fixing treatment at each temperature with an external fixing device, an modified device of an oilless fixing system "DL-2300" (commercially available from Konica Minolta Business Technologies, Inc.) (a device in which a fixing roller was set at a rotational speed of 265 mm/sec, and a fixing roller temperature in the fixing device was made variable), while raising the fixing roller temperatures from 100° to 230° C. in an increment of 5° C., to perform a solid image printing. After the solid image printing was performed at each temperature, a plain blank paper was subsequently allowed to pass through the fixing roller. A temperature at which offset image is generated on the plain blank paper before the offset image is no longer present is defined as a cold offset generating temperature. In addition, a temperature at which offset image is generated on the plain blank paper after further raising the temperature of the fixing roller is defined as a hot offset generating temperature. The results are shown in Table 5.

Test Example 10

Fixing Temperature Region

A difference between (A) a temperature whichever that is higher of either (i) a temperature calculated from a cold offset generating temperature plus(+) 5° C. [a cold offset generating temperature+5° C.], or (ii) a lowest fixing temperature, and (B) a temperature calculated from a hot offset temperature minus(−) 5° C. [a hot offset generating temperature−5° C.] is defined as a fixing temperature region. The results are shown in Table 5.

Test Example 11

Image Quality Reliability on Durability Printing

A toner was loaded to a printer "ML5400" commercially available from Oki Data Corporation, and continuous printing was carried out at a print coverage of 0.1%. Solid images were printed every 1,000 sheets, and image quality was visually confirmed to evaluate its durability. The number of printed sheets until which nonuniform image density or streak was generated was the item to be evaluated. The continuous printing was performed up to 10,000 sheets, and a case where the number of printed sheets was 5,000 sheets or more was evaluated as being acceptable. The results are shown in Table 5.

TABLE 5

| | Lowest Fixing Temp. (° C.) | Low-Temp. Offset Generating Temp. (° C.) | High-Temp. Offset Generating Temp. (° C.) | Fixing Temp. Region (° C.) | Image Quality Reliability on Durability Printing (sheets) |
|---|---|---|---|---|---|
| Ex. 16 | 130 | 125 | 230< | 100< | 10,000< |
| Ex. 17 | 135 | 130 | 230< | 95< | 10,000 |
| Comp. Ex. 5 | 145 | 135 | 220 | 70 | 4,000 |
| Comp. Ex. 6 | 140 | 135 | 195 | 50 | 4,000 |

It can be seen from the above results that the toners of Examples 16 and 17 have excellent low-temperature fixing ability and offset resistance, wide fixing temperature regions, inhibited filming on blades or the like, and excellent image quality reliability on durability printing, as compared to the toners of Comparative Examples 5 and 6.

The toner of the present invention is usable in, for example, development of latent images formed in electrophotography, electrostatic recording method, electrostatic printing method or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner comprising a resin binder comprising at least two types of polyesters having softening points that differ by 10° C. or more, a colorant and a charge control agent, wherein the at least two types of polyesters comprise a polyester A having a softening point of from 105° to 140° C. and a glass transition temperature of from 30° to 55° C., and a polyester B having a softening point of from 140° to 170° C. and a glass transition temperature of exceeding 55° C. and 80° C. or lower, (i) wherein the polyester A is a polyester obtained from a succinic acid substituted with an alkyl group having 1 to 20 carbon atoms or an alkenyl group having 2 to 20 carbon atoms, as a carboxylic acid component of a raw material monomer, and wherein an amount of the succinic acid substituted with an alkyl group having 1 to 20 carbon atoms or an alkenyl group having 2 to 20 carbon atoms in the polyester A is from 16 to 50% by mole based on the total amount of the raw material monomers in the polyester A in the resin binder, and (ii) wherein in all of the polyesters in the resin binder, the succinic acid substituted with an alkyl group having 1 to 20 carbon atoms or an alkenyl group having 2 to 20 carbon atoms is contained in an amount from 10.0 to 18.5% by mole based on the total amount of the raw material monomers in all of the polyesters in the resin binder.

2. The toner according to claim 1, wherein the polyester A and the polyester B have a difference in glass transition temperatures of from 5° to 40° C.

3. The toner according to claim 1, wherein a weight ratio of the polyester A and the polyester B, the polyester A/the polyester B, is from 20/80 to 80/20.

4. The toner according to claim 1, further comprising an amide compound having 10 to 70 carbon atoms.

5. The toner according to claim 1, wherein the charge control agent is a positively chargeable charge control agent, and the toner is a positively chargeable toner.

6. The toner according to claim 5, wherein an amount of the positively chargeable charge control agent is from 0.3 to 20 parts by weight, based on 100 parts by weight of the resin binder.

7. A toner comprising a resin binder comprising at least two types of polyesters having softening points that differ by 10° C. or more, a colorant and a charge control agent, wherein the at least two types of polyesters comprise a polyester A having a softening point of from 105° to 140° C. and a glass transition temperature of from 30° to 55° C., and a polyester B having a softening point of from 140° to 170° C. and a glass transition temperature of exceeding 55° C. and 80° C. or lower, wherein the resin binder comprises at least one polyester obtained from a succinic acid substituted with an alkyl group having 1 to 20 carbon atoms or an alkenyl group having 2 to 20 carbon atoms as a raw material monomer, and wherein an amount of the succinic acid substituted with an alkyl group having 1 to 20 carbon atoms or an alkenyl group having 2 to 20 carbon atoms in all the polyesters in the resin binder is from 10.0 to 18.5% by mole based on the total amount of the raw material monomers of all of the polyesters in the resin binder.

8. The toner according to claim 7, further comprising an amide compound having 10 to 70 carbon atoms.

9. A toner comprising a resin binder comprising two types of polyesters having softening points that differ by 10° C. or more, a colorant, and a charge control agent, wherein the two types of polyesters comprise a polyester A having a softening point of from 105° to 140° C. and a glass transition temperature of from 30° to 55° C., and a polyester B having a softening point of from 140° to 170° C. and a glass transition temperature of exceeding 55° C. and 80° C. or lower, (i) wherein the polyester A is a polyester obtained from a succinic acid substituted with an alkyl group having 8 to 16 carbon atoms or an alkenyl group having 8 to 16 carbon atoms, as a carboxylic acid component of a raw material monomer, and wherein an amount of the succinic acid substituted with an alkyl group having 8 to 16 carbon atoms or an alkenyl group having 8 to 16 carbon atoms is from 20 to 40% by mole based on the total amount of the raw material monomers of the polyester A in the resin binder, (ii) wherein in all of the polyesters in the resin binder, the succinic acid substituted with an alkyl group having 1 to 20 carbon atoms or an alkenyl group having 2 to 20 carbon atoms is contained in an amount from 10.0 to 18.5% by mole based on the total amount of the raw material monomers in all of the polyesters in the resin binder.

10. The toner according to claim 9, further comprising an amide compound having 10 to 70 carbon atoms.

* * * * *